US007746236B2

(12) United States Patent
Cole

(10) Patent No.: US 7,746,236 B2
(45) Date of Patent: Jun. 29, 2010

(54) FIRE DETECTION SYSTEM AND METHOD

(75) Inventor: Barrett E. Cole, Bloomington, MN (US)

(73) Assignee: Honeywell International Inc., Morristown, NJ (US)

( * ) Notice: Subject to any disclaimer, the term of this patent is extended or adjusted under 35 U.S.C. 154(b) by 345 days.

(21) Appl. No.: 11/742,654

(22) Filed: May 1, 2007

(65) Prior Publication Data

US 2008/0272921 A1 Nov. 6, 2008

(51) Int. Cl.
*G08B 17/12* (2006.01)

(52) U.S. Cl. ..... 340/577; 340/584; 340/588; 250/338.1

(58) Field of Classification Search ..... 340/525, 340/628, 632, 555, 584, 577–579, 581, 588, 340/589; 250/221, 338.1, 342
See application file for complete search history.

(56) References Cited

U.S. PATENT DOCUMENTS

| | | | | |
|---|---|---|---|---|
| 5,021,644 | A * | 6/1991 | Beran et al. | 250/221 |
| 5,159,200 | A | 10/1992 | Dunbar et al. | |
| 5,218,345 | A | 6/1993 | Muller et al. | |
| 5,260,225 | A | 11/1993 | Liu et al. | |
| 5,734,335 | A | 3/1998 | Brogi et al. | |
| 5,764,146 | A * | 6/1998 | Baldwin et al. | 340/567 |
| 5,877,688 | A * | 3/1999 | Morinaka et al. | 340/584 |
| RE36,706 | E | 5/2000 | Cole | |
| 6,111,511 | A | 8/2000 | Sivathanu et al. | |
| 6,150,659 | A | 11/2000 | Baliga et al. | |
| 6,384,732 | B1 | 5/2002 | Schumer | |
| 6,515,283 | B1 | 2/2003 | Castleman et al. | |
| 6,518,574 | B1 | 2/2003 | Castleman | |
| 6,759,657 | B2 | 7/2004 | Iida et al. | |
| 6,809,320 | B2 | 10/2004 | Iida et al. | |
| 6,844,538 | B1 | 1/2005 | Hollock et al. | |
| 6,882,272 | B2 | 4/2005 | Pfefferseder et al. | |
| 6,958,689 | B2 * | 10/2005 | Anderson et al. | 340/525 |
| 6,974,953 | B2 | 12/2005 | Iida et al. | |
| 7,002,153 | B1 | 2/2006 | Gillham et al. | |
| 7,045,785 | B2 | 5/2006 | Iida et al. | |
| 7,066,273 | B2 | 6/2006 | Tan | |
| 7,087,900 | B2 | 8/2006 | Iida et al. | |
| 2003/0132847 | A1 | 7/2003 | Anderson | |
| 2006/0061654 | A1 | 3/2006 | McKay et al. | |

FOREIGN PATENT DOCUMENTS

| | | |
|---|---|---|
| EP | 0432680 | 6/1991 |
| WO | 2006108210 | 10/2006 |

* cited by examiner

*Primary Examiner*—Anh V La
(74) *Attorney, Agent, or Firm*—Crompton Seager & Tufte LLC

(57) ABSTRACT

A fire detection system for detecting fires may include an infrared detector array. The fire detection system may use the infrared detector array to monitor the temperature of a target environment over time. In some cases, a positioning apparatus may be used to move the field of view of the infrared detector array, allowing the infrared detector array to scan a relatively large target environment while still achieving a given resolution.

18 Claims, 10 Drawing Sheets

FIRE DETECTION SYSTEM AND METHOD

TECHNICAL FIELD

The disclosure pertains generally to fire detection, and more particularly, to detecting fire using an infrared detector or detector array.

BACKGROUND

A variety of smoke and/or fire detectors are known. Smoke and/or fire detectors may be adapted to detect combustion gases that are produced by a smoldering or openly burning fire, or to thermally detect the increased heat that may be produced by a fire. However, in some cases, these detectors are not particularly adept at detecting a fire while in the early stages of development.

A need remains for a fire detection system that can detect fires while in an early stage of development, which can help to provide advance warning and/or minimize the damage that may otherwise occur as a result of a growing fire.

SUMMARY

The disclosure pertains to a fire detection system that can detect fires while in an early stage of development. In some illustrative embodiments, an infrared detector array may be used to monitor a target environment over time, and detect a fire via an increased infrared radiation given off by the fire. In some cases, an infrared detector array may be coupled to an apparatus that permits lateral and/or vertical movement of the field of view of the array, thereby permitting a given size array to monitor a larger target environment.

The above summary of the disclosure is not intended to describe each disclosed embodiment or every implementation of the present invention. The Figures and Detailed Description that follow more particularly exemplify these embodiments.

BRIEF DESCRIPTION OF THE FIGURES

The disclosure may be more completely understood in consideration of the following detailed description of various embodiments of the invention in connection with the accompanying drawings, in which.

Figure 1:
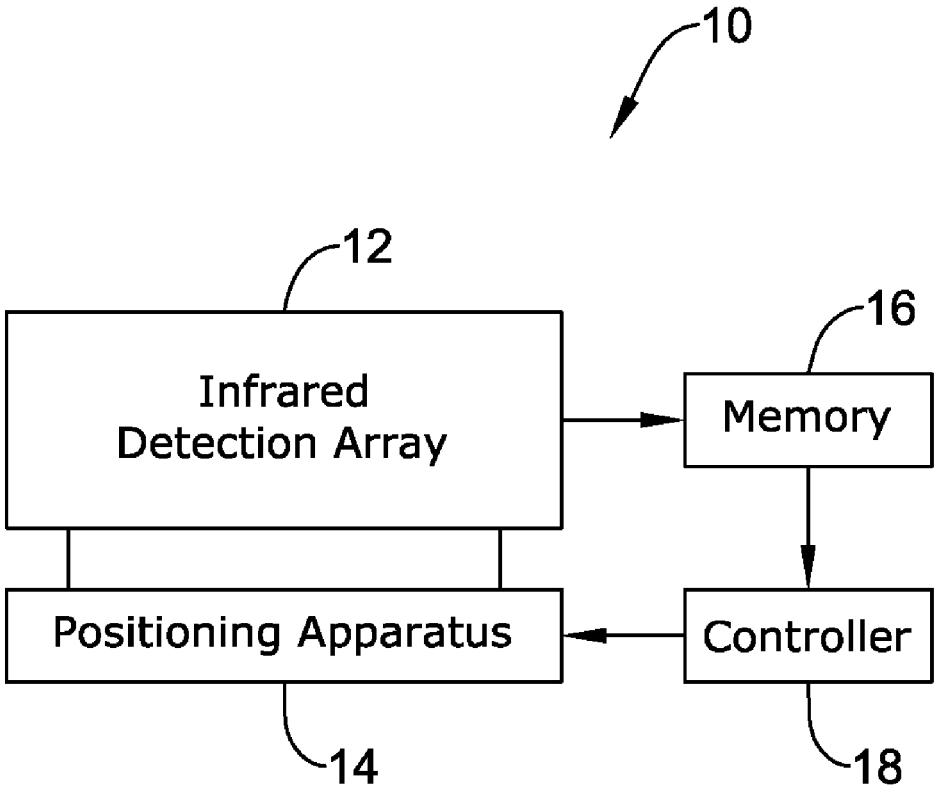
FIG. 1 is a high level block diagram of an illustrative but non-limiting fire detection system.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is a high level block diagram of an illustrative but non-limiting fire detection system 10. The illustrative fire detection system 10 includes an infrared detector array 12 that may be disposed on or otherwise connected to a positioning apparatus 14. A memory block 16 may be configured to accept and/or store information provided by infrared detector array 12. A controller 18 may be configured to provide positioning commands to positioning apparatus 14. Controller 18 may include programming that permits controller 18 to process and/or analyze data stored within memory block 16. In some cases, data from infrared detector array 12 may pass through controller 18 before entering memory block 16, rather than passing directly to memory block 16 as illustrated. In some cases, memory block 16 may include programming for controller 16. Although memory block 16 is illustrated as a distinct element from controller 18, it is contemplated that memory block 16 may be integrated into controller 18.

The infrared detector array 12 may include any suitable detectors or sensors that are sensitive to infrared radiation, particularly detectors or sensors that are sensitive to particular wavelengths of infrared radiation that are manifested in small but growing fires, such as an array of microbolometers or CCD elements. Infrared detector array 12 may include a plurality of individual detectors or sensors, as shown in, for example, FIG. 2.

Figure 2:
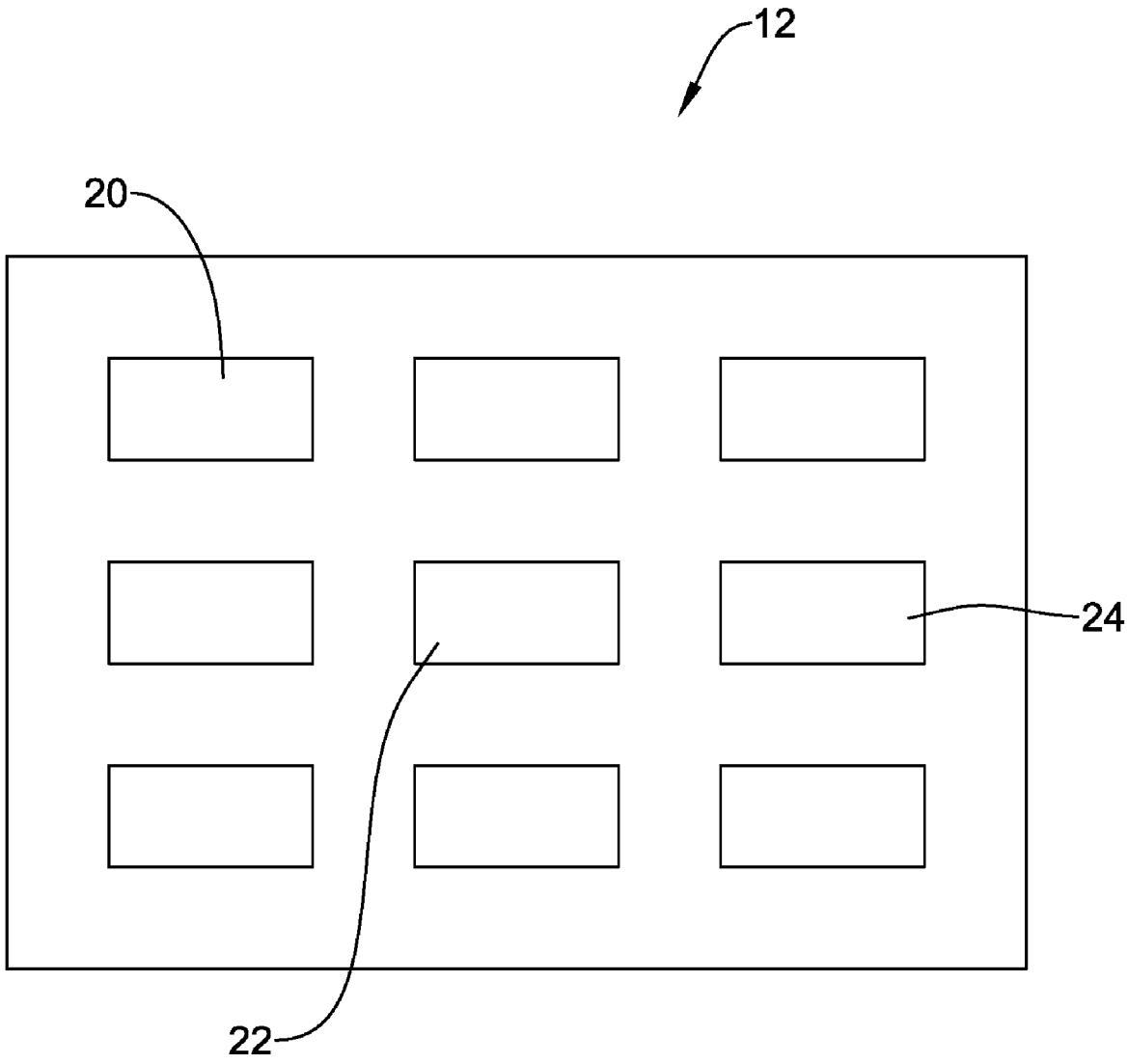
FIG. 2 is a schematic diagram of an infrared detector array that may be employed within the illustrative fire detection system of FIG. 1.

In FIG. 2, infrared detector array 12 is illustrated as having a total of nine distinct detectors 20, arranged in a three-by-three array. It will be recognized that this is merely for illustrative purposes, as infrared detector array 12 may have significantly more or less than nine detectors 20. In some cases, infrared detector array 12 may have, for example, 9600 distinct sensors 20 arranged in a sixty-by-one-sixty array. The number of total detectors 20, and the way in which the detectors 20 are arranged, may be varied to accommodate the particular environment in which fire detection system 10 (FIG. 1) is to be used, such as individual rooms, offices, computer rooms, labs, and the like. It will be recognized that the field of view of each detector 20 may correspond to a particular location within the target environment, and thus infrared detector array 12 may be considered as seeing a number of spatially arranged locations within the target environment.

In some cases, there may be a tradeoff involved in determining the overall size of infrared detector array 12. As the total number of detectors 20 increases, the field of view of the infrared detector array 12 may correspond to a larger portion of the target environment. This may reduce the cost and complexity of any positioning apparatus 14 (FIG. 1) that may be used to pan and/or tilt the field of view of the infrared detector array 12 across the target environment. However, the cost and complexity of the infrared detector array 12 may increase. Conversely, making infrared detector array 12 smaller may reduce the cost and complexity of infrared detector array 12, but may result in a more costly and/or more complicated positioning apparatus 14 in some cases.

In some instances, each of the detectors 20 may be identical, and thus may be sensitive to the same wavelength or ranges of wavelengths within the infrared spectrum. In other cases, it is contemplated that some of the detectors 20 may be sensitive to a different wavelength or wavelengths of light within the infrared or other spectrum (e.g. visible spectrum). Alternatively, or in addition, it is contemplated that some of the detectors 20 may be faster acting than other detectors. For example, a detector 22 may be configured to be most sensitive to radiation within a first range of wavelengths and may provide more data but perhaps may be less sensitive to changes in incoming light (e.g. slower acting). A detector 24 may be configured to be most sensitive to light within the same or a different range of wavelengths, but may be more sensitive to changes in incoming radiation (e.g. faster acting), but may not provide as much data. By combining detector 22 and detector 24 in an array, a desired balance of sensitivity versus data volume may be achieved.

Returning to FIG. 1, positioning apparatus 14 may be any suitable device that is capable of moving the field of view of the infrared detector array 12 as needed. In some cases, positioning apparatus 14 may be configured to move infrared detector array 12 in a horizontal direction and/or a vertical direction, thereby changing the field of view and thus the scene that is delivered to the infrared detector array 12. In some cases, positioning apparatus 14 may be configured to move infrared detector array 12 through a sinusoidal motion. If desired, positioning apparatus 14 may include, for example, a first motor positioned and geared to move a platform up and down and a second motor positioned and geared to move a platform left and right. Infrared detector array 12 may, for example, be secured to this platform, and thus can be moved as desired. In some cases, the motors may be controlled by controller 18.

Alternatively, or in addition, it is contemplated that positioning apparatus 14 may move optics associated with the infrared detector array 12. For example, one or more lenses that define the field of view of the infrared detector array 12 may be moved relative to the infrared detector array 12 to change the scene that is delivered to the infrared detector array 12. Alternatively, one or more mirrors may be provided to reflect a desired scene to the infrared detector array 12. The positioning apparatus 14 may be configured to move the one or more mirrors to change the field of view of the infrared detector array 12, and thus the scene that is delivered to the infrared detector array 12.

It will be recognized that fire detection system 10 may be used to monitor a target environment for indications of fire. Controller 18 may be programmed to move the field of view of the infrared detector array 12, via positioning apparatus 14, as necessary to view all of the target environment that fire detection system 10 is designed to monitor. Controller 18 and/or memory block 16, if distinct, may store data relating to temperatures from each of a number of distinct and/or spatially arranged locations within the target environment. This data may be compared and/or tracked over time, thereby permitting controller 18 to recognize increasing temperatures that may indicate a growing fire. In some cases, the spatially arranged nature of the locations being monitored permit controller 18 to identify a location of a potential fire within the target environment.

In some illustrative embodiments, fire detection system 10 may be programmed to watch for temperature increases that exceed a particular threshold. In some instances, for example, fire detection system 10 may be programmed to watch for actual sensed temperatures that are above a particular threshold. For example, any measured temperature that exceeds 100° C. may trigger an alarm. Alternatively, or in addition, fire detection system 10 may be programmed to watch for temperatures changes that exceed a particular threshold. For example, fire detection system 10 may be trigger an alarm if any specific location increases more than say 5° C., or perhaps 10° C., over some predefined temperature, and/or if any specific location increases more than say 25° C. in the span of say 10 seconds. These temperatures and time periods are only illustrative, and it is contemplated that any suitable temperatures and time period may be used, as desired.

If a particular environment is expected to include humans, either intermittently or constantly, the thresholds at which an alarm may sound may be adjusted so that the infrared radiation emanating from the person as a result of their body temperature will not set off alarms. In some cases, however, the fire detection system 10 may be programmed to acts as an intruder alarm, and such temperature changes may set off an intrusion alarm, if desired.

If fire detection system 10 detects a potential fire, either as a result of detecting a temperature that is above a threshold, or by detecting a temperature that is increasing over time, several different actions may be taken. In some cases, the first sign of a potential fire may result in an alarm sounding, notifying the authorities, and the like. In some instances, controller 18 may command positioning apparatus 14 to move infrared detector array 12 so that different detector(s) 20 correspond to the detected fire. As a result, the suspect location or locations within the target environment may be monitored and/or checked using different detectors 20 within infrared detector array 12. This can help reduce false alarms that could otherwise be caused by a poorly functioning detector 20. Fire detection system 10 may also be used to cause a fire retardant to be directed at the detected fire.

Fire detection system 10 may be programmed to operate in accordance with a variety of different algorithms that may be used to detect potential fires. FIGS. 3 through 11 provide illustrate but non-limiting examples of such algorithms.

Figure 3:
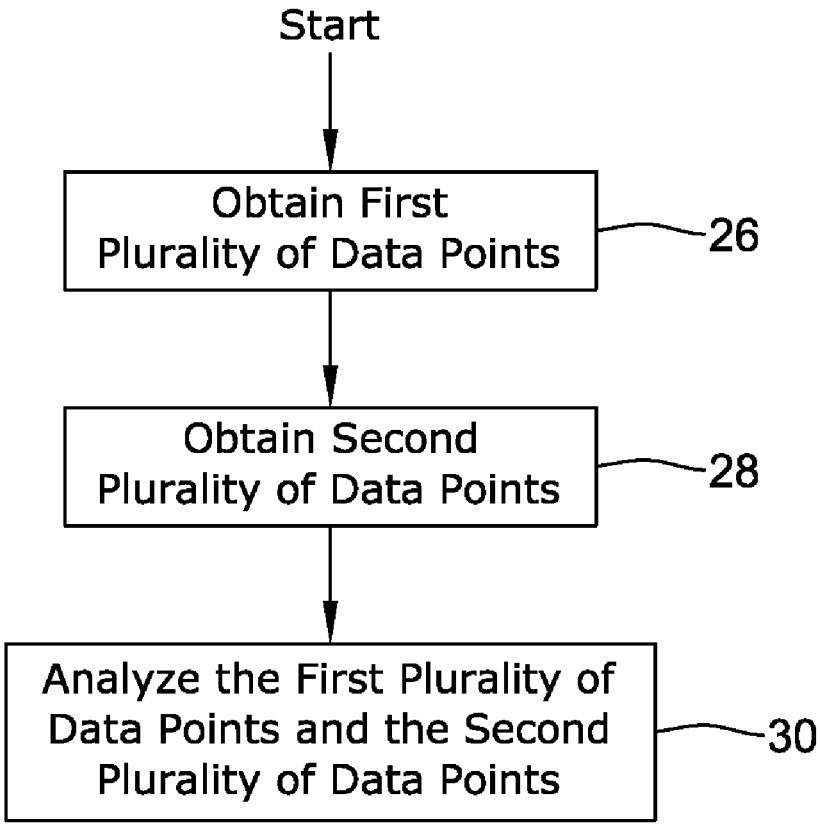
FIG. 3 is a flow diagram showing an illustrative method that may be carried out using the illustrative fire detection system of FIG. 1.

FIG. 3 is a flow diagram showing an illustrative method that may be carried out using fire detection system 10 (FIG. 1). At block 26, infrared detector array 12 (FIG. 1) obtains a first plurality of data points. In some cases, the first plurality of data points may provide a temperature or a numerical value proportional to a temperature for each of a plurality of spatially arranged locations of the target environment that are being monitored by the plurality of detectors 20 (FIG. 1). At block 28, a second plurality of data points may be obtained. In the illustrative method, the second plurality of data points may be temporally spaced in time from the first plurality of data points, i.e., the second plurality of data points are obtained some time after obtaining the first plurality of data points.

Control passes to block 30, where controller 18 (FIG. 1) may analyze the first plurality of data points and the second plurality of data points. In some cases, each of the first plurality of data points may be compared to a corresponding data point within the second plurality of data points, looking for numerical changes that may indicate an increasing temperature, and in turn, a fire that is beginning and/or growing.

Figure 4:
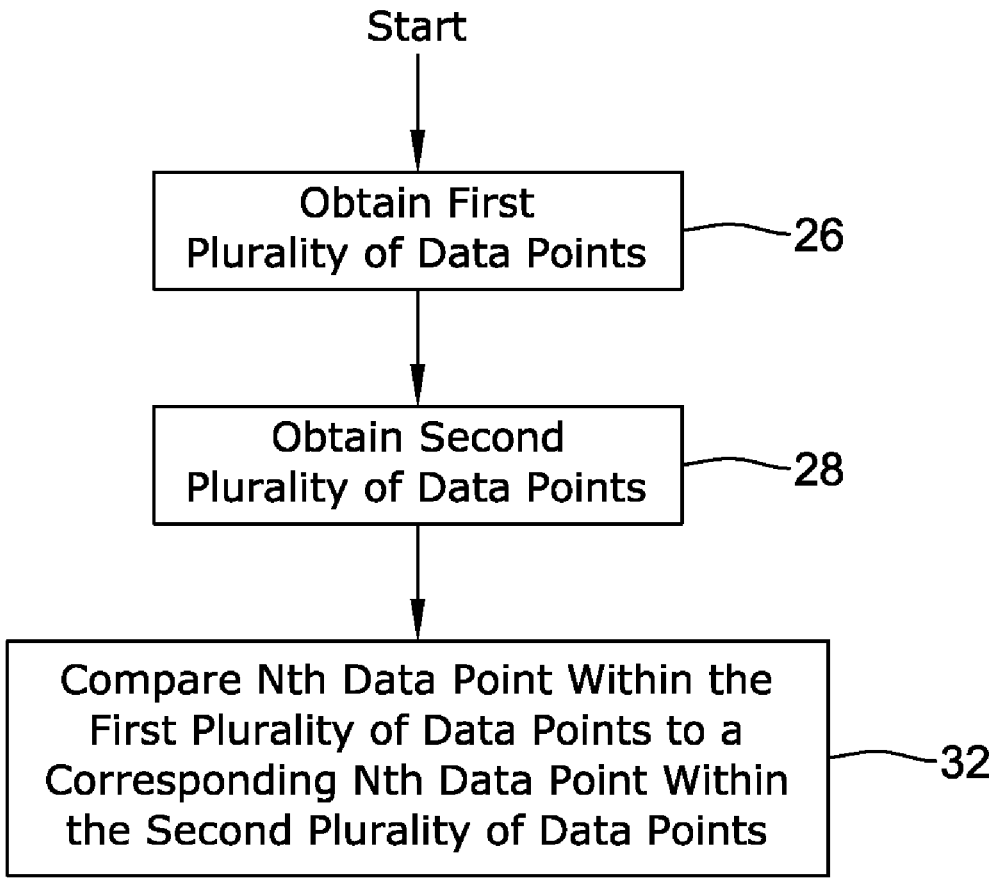
FIG. 4 is a flow diagram showing an illustrative method that may be carried out using the illustrative fire detection system of FIG. 1.

FIG. 4 is a flow diagram showing an illustrative method that may be carried out using fire detection system 10 (FIG. 1). At block 26, infrared detector array 12 (FIG. 1) obtains a first plurality of data points, as discussed previously with respect to FIG. 3. At block 28, a second plurality of data points may be obtained. Again, the second plurality of data points may be temporally spaced in time from the first plurality of data points.

Control is passes to block 32, where controller 18 (FIG. 1) may compare an $n^{th}$ data point within the first plurality of data points to a corresponding $n^{th}$ data point within the second plurality of data points, looking for numerical changes that may indicate an increasing temperature, and in turn, a fire that is beginning and/or growing. "N" may represent an integer from 1 to the number of detectors 20 in the infrared detector array 12.

Figure 5:
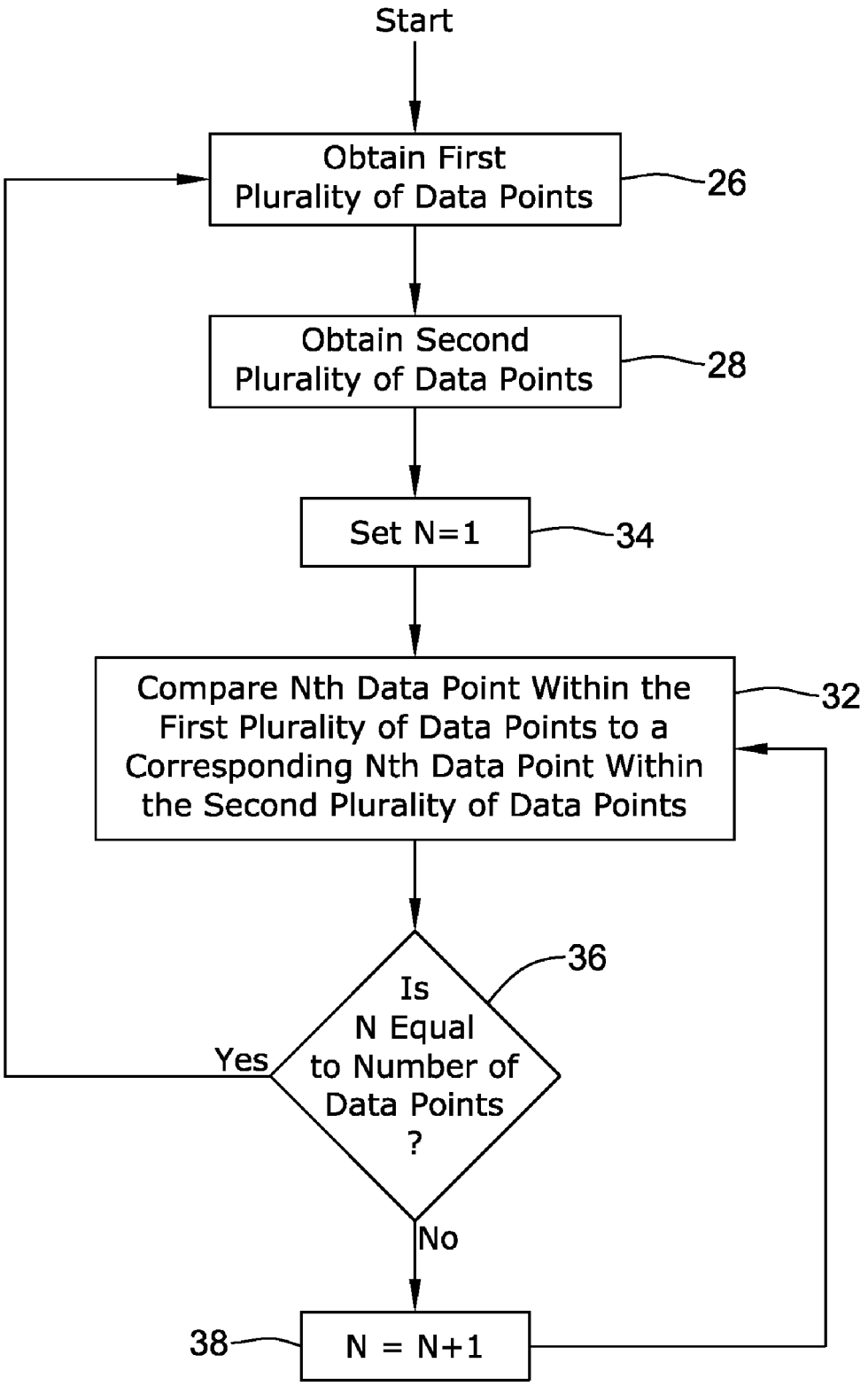
FIG. 5 is a flow diagram showing an illustrative method that may be carried out using the illustrative fire detection system of FIG. 1.

FIG. 5 is a flow diagram showing an illustrative method that may be carried out using fire detection system 10 (FIG. 1). At block 26, infrared detector array 12 (FIG. 1) obtains a first plurality of data points, as discussed previously with respect to FIG. 3. At block 28, a second plurality of data points may be obtained. Again, the second plurality of data points may be temporally spaced in time from the first plurality of data points.

At block 34, "n" is set equal to one. Like above, "n" may represent an integer from 1 to the number of detectors 20 in the infrared detector array 12. Control passes to block 32, where controller 18 (FIG. 1) compares an $n^{th}$ data point within the first plurality of data points to a corresponding $n^{th}$ data point within the second plurality of data points, looking for numerical changes that may indicate an increasing temperature, and in turn, a fire that is beginning and/or growing.

Control passes to decision block 36, where controller 18 (FIG. 1) determines if all the data points have been compared, i.e., if n now corresponds to a last detector 20 in the infrared detector array 12, If so, the comparing process stops. In some cases, control reverts to block 26 and the process begins anew. If not, "n" is incremented at block 38, and control reverts to block 32. Thus, in this illustrative method, each data point within the first plurality of data points is compared to each corresponding data point within the second plurality of data points.

In some cases, the target environment may be too large for infrared detector array 12 to view all of the target environment at one time and still obtain a desired resolution. As such, and depending on the number of detectors provided in infrared detector array 12, the size of the target environment, and the desired resolution, it may be desirable to move the field of view of infrared detector array 12 around the room. Said another way, it may be useful to divide the target environment into two or more portions that can checked sequentially. Each of the two or more portions may be at least partially distinct, and positioning apparatus 14 (FIG. 1) may move infrared detector array 12 as needed to view each of the two or more portions sequentially.

For example, positioning apparatus 14 may be configured to move infrared detector array 12 in a horizontal direction and/or a vertical direction, thereby changing the field of view, and thus the scene that is delivered to infrared detector array 12. Alternatively, or in addition, it is contemplated that positioning apparatus 14 may move optics associated with infrared detector array 12 to change the scene that is delivered to infrared detector array 12. Alternatively, or in addition, one or more mirrors may be provided to reflect a desired scene to infrared detector array 12, and positioning apparatus 14 may be configured to move the one or more mirrors to change the field of view of infrared detector array 12 and thus the scene that is delivered to infrared detector array 12.

Figure 6:
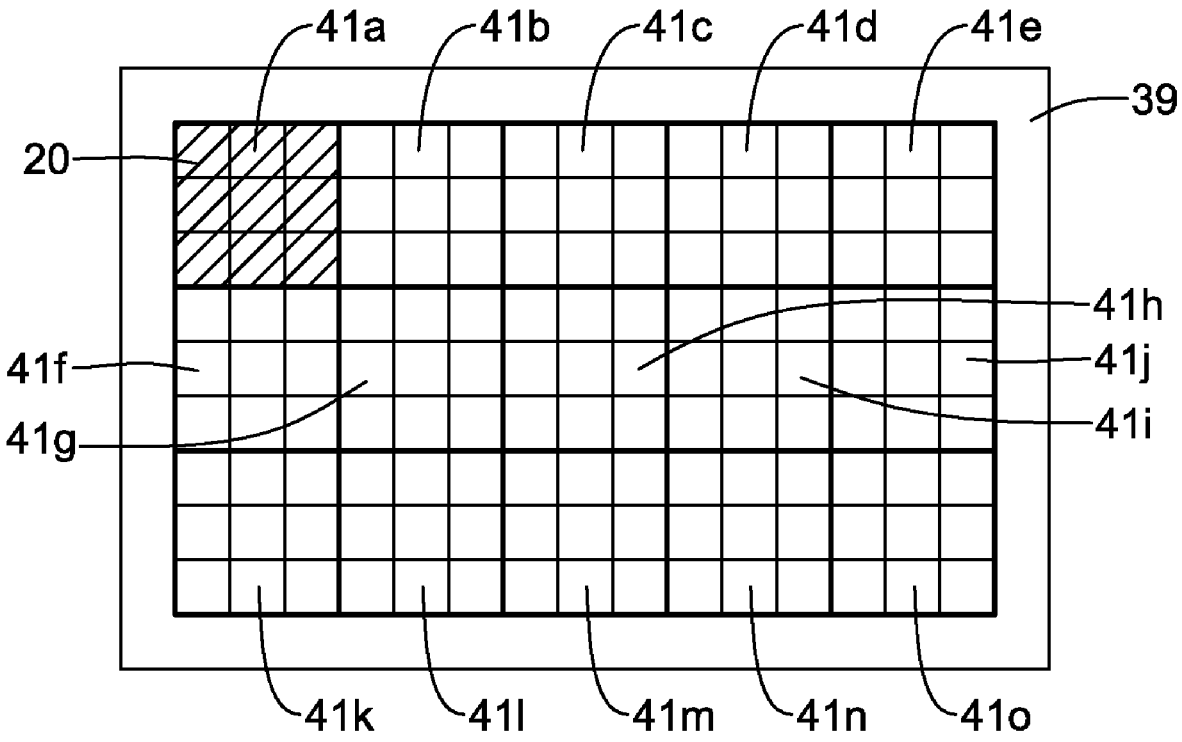
FIG. 6 is a diagrammatic view of an illustrative target environment that has been divided into two or more portions that can sequentially analyzed.

FIG. 6 is a diagrammatic view of an illustrative target environment 39 that has been divided into two or more portions 41*a*-41*o* that can checked sequentially. Each of the two or more portions 41*a*-41*o* are shown as bold dark rectangles. In the illustrative diagram, a first portion 41*a* (indicated in cross-hatch) of target environment 39 may correspond to a first field of view of infrared detector array 12. The first field of the view of infrared detector array 12 may cause detectors 20 (FIG. 2) of the illustrative infrared detector array 12 to be staring at the first portion 41*a* of the target environment 39. Once data is taken for each of the detectors 20 at the first portion 41*a* of target environment 39, the field of view of infrared detector array 12 may be moved to a second portion 41*b* of target environment 39, and data may again be taken. This may continue until data for each of the detectors 20 has been taken for each of the portions 41*a*-41*o* of target environment 39.

In some cases, the field of view of infrared detector array 12 may be moved back to first portion 41*a* of target environment 39, and data may again be taken for each of the detectors 20. This data may be temporally spaced in time from the data previously taken for the first portion 41*a* of target environment 39. Any changes in detected temperature may be identified, sometimes on a detector-by-detector basis, to help determine if a fire is present in target environment 39. The location of a detected fire may be identified by determining the particular field of view, and in some cases, the particular detector or detectors, that indicate an increase in temperature.

In some instances, the field of view of infrared detector array 12 may, for example, remain focused on portion 41*a* of target environment 39 long enough for three, four or more temporally spaced data sets to be obtained and analyzed for indications of increasing temperature. Once portion 41*a* has been analyzed, the field of view of infrared detector array 12 may, for example be moved to portion 41*b*. In this manner, temporally spaced data for each of portions 41*a* through 41*o* of target environment 39 may be obtained while keeping the field of view of infrared detector array 12 focused on a particular portion of target environment 39. Once data has been obtained for a particular portion of target environment 39, the field of view of infrared detector array 12 may be moved to the next portion.

In some cases, a single data set may be obtained from each of the portions 41*a*-41*o*, and then the field of view of infrared detector array 12 may return to focus on each of the portions 41*a* through 41*o*, as discussed above, in order to obtain temporally spaced data that can be compared to the previously-obtained data. In some cases, if a potential temperature increase is detected, the field of view of infrared detector array 12 may be positioned to focus on a suspect portion of the target environment 39 to obtain further data pertaining to temperatures within the suspect portion of the environment. As a result, it is possible to determine if a detected temperature rise is merely an imaging anomaly or if there is indeed a potential fire.

Figure 7:
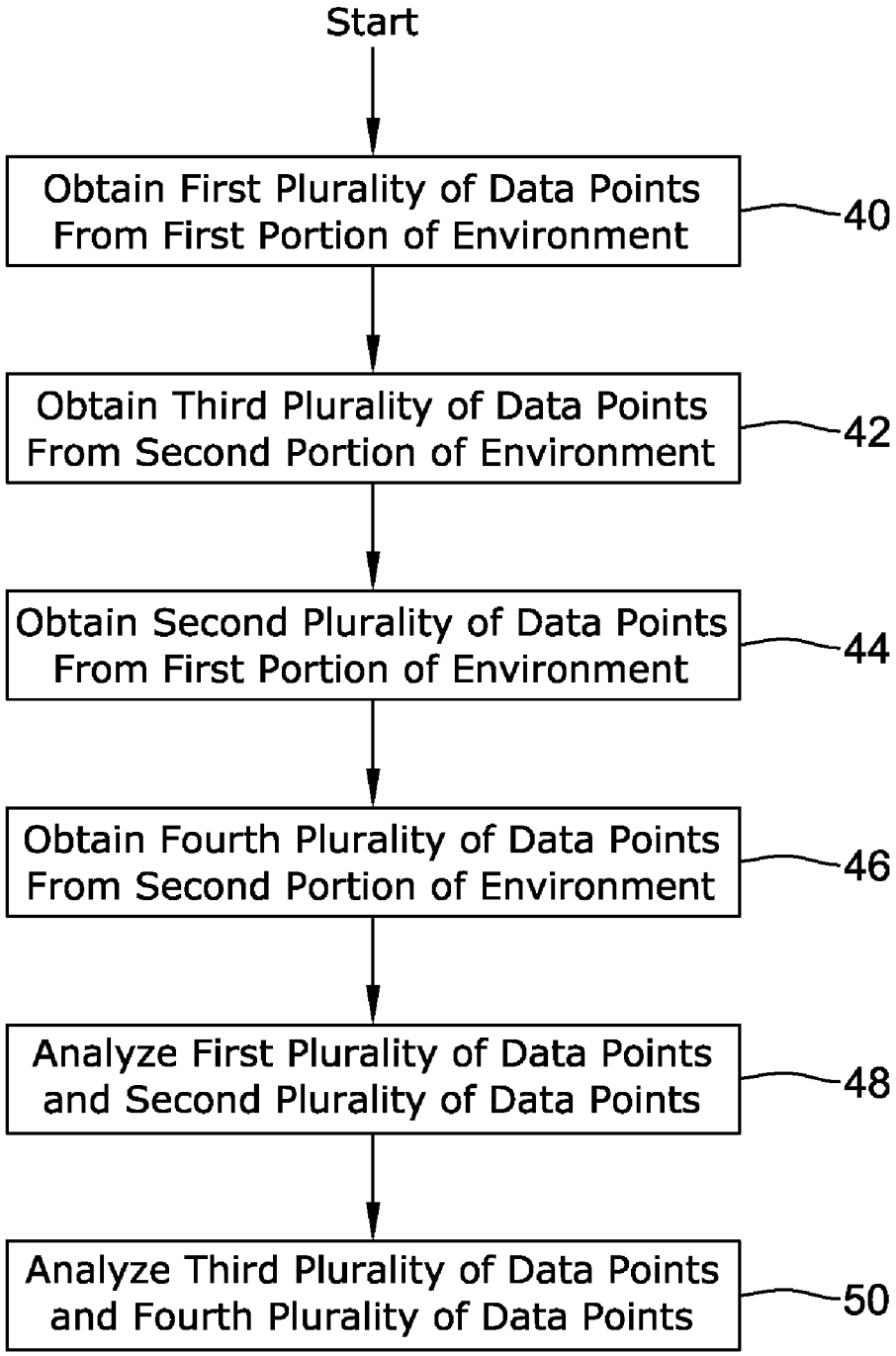
FIG. 7 is a flow diagram showing an illustrative method that may be carried out using the illustrative fire detection system of FIG. 1.

FIG. 7 is a flow diagram showing an illustrative method that may be carried out using fire detection system 10 (FIG. 1). In FIG. 7, target environment 39 has been divided, for illustrative purposes, into a first portion and a second portion (e.g. first portion 41*a* and second portion 41*b*). The data obtained from the first portion have been designated as a first plurality of data points and a second plurality of data points while the data obtained from the second portion have been designated as a third plurality of data points and a fourth plurality of data points. The first, second, third and fourth should not necessarily be interpreted as being strictly chronological.

At block 40, infrared detector array 12 (FIG. 1) obtains a first plurality of data points (e.g. corresponding to the plurality of detectors 20 of FIG. 2) from a first portion (e.g. first portion 41*a*) of the target environment. At block 42, infrared detector array 12 obtains a third plurality of data points (e.g. corresponding to the plurality of detectors 20 of FIG. 2) from a second portion (e.g. second portion 41*b*) of the target environment 39.

Control passes to block 44, where infrared detector array 12 obtains a second plurality of data points (e.g. corresponding to the plurality of detectors 20 of FIG. 2) from the first portion (e.g. first portion 41*a*). In some cases, the second plurality of data points may be construed as being temporally spaced in time from the first plurality of data points. At block 46, a fourth plurality of data points (e.g. corresponding to the plurality of detectors 20 of FIG. 2) are obtained from the second portion (e.g. second portion 41*b*) of the target environment 39. The fourth plurality of data points may be construed as being temporally spaced in time from the third plurality of data points.

Control passes to block 48, where controller 18 (FIG. 1) analyzes the first plurality of data points and the second plurality of data points. This may provide information pertaining to any potential fire starting within the first portion (e.g. first portion 41*a*) of the target environment 39. At block 50, controller 18 analyzes the third plurality of data points and the fourth plurality of data points. This may provide information pertaining to any potential fire starting within the second portion (e.g. second portion 41*b*) of the target environment 39.

Figure 8:
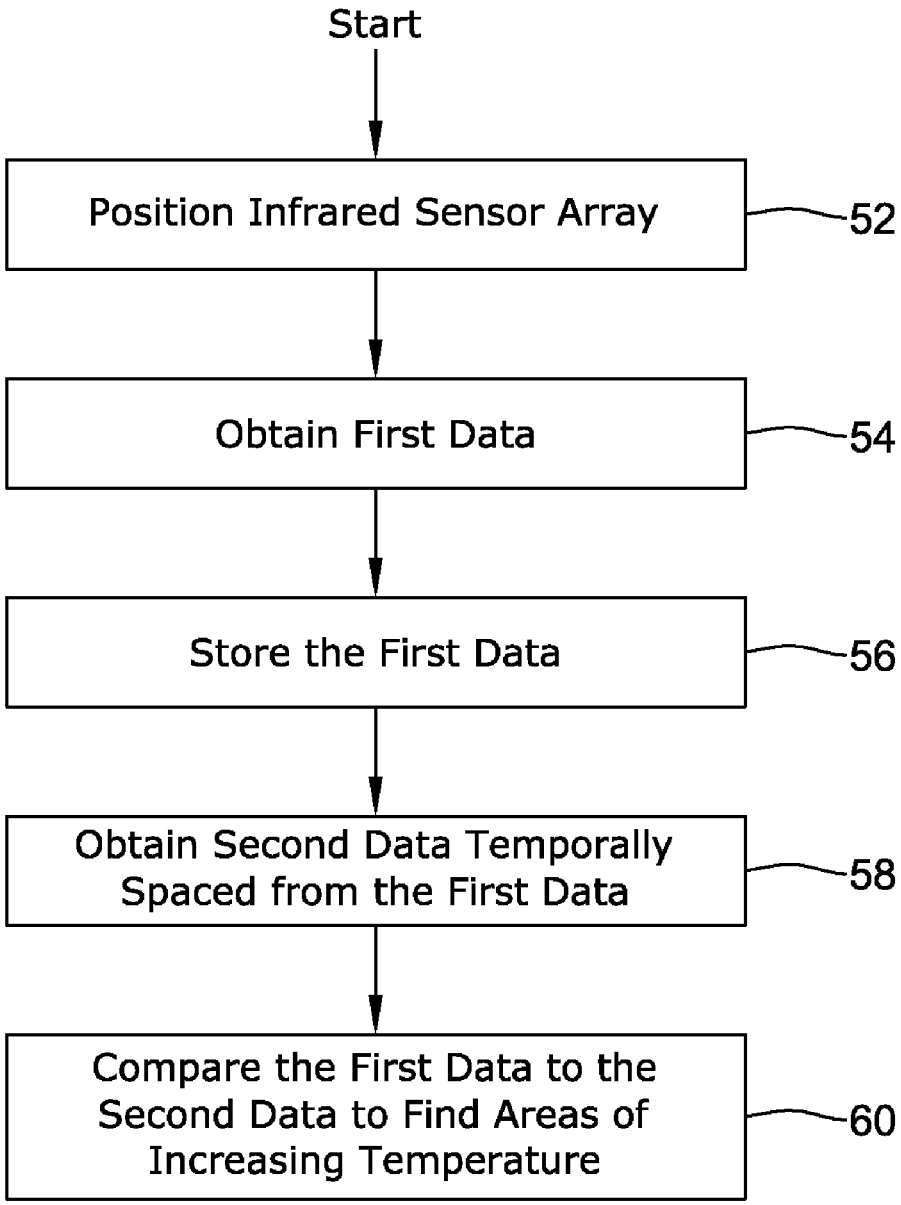
FIG. 8 is a flow diagram showing an illustrative method that may be carried out using the illustrative fire detection system of FIG. 1.

FIG. 8 is a flow diagram showing an illustrative method that may be carried out using fire detection system 10 (FIG. 1). At block 52, infrared detector array 12 (FIG. 1) is positioned, such as using positioning apparatus 14 of FIG. 1. At block 54, first data is obtained and is stored at block 56. In some cases, the first data may be stored within memory block 16 of FIG. 1. At block 58, second data, which is temporally spaced in time from the first data, is obtained. In this, first data may refer to a first plurality of data points (e.g. corresponding to the plurality of detectors 20 of FIG. 2) and second data may refer to a second plurality of data points (e.g. corresponding to the plurality of detectors 20 of FIG. 2). Control passes to block 60, where controller 18 (FIG. 1) compares the first data to the second data to find areas of increased or increasing temperature. As noted above, increased or increasing temperature may be indicative of a potential fire.

Figure 9:
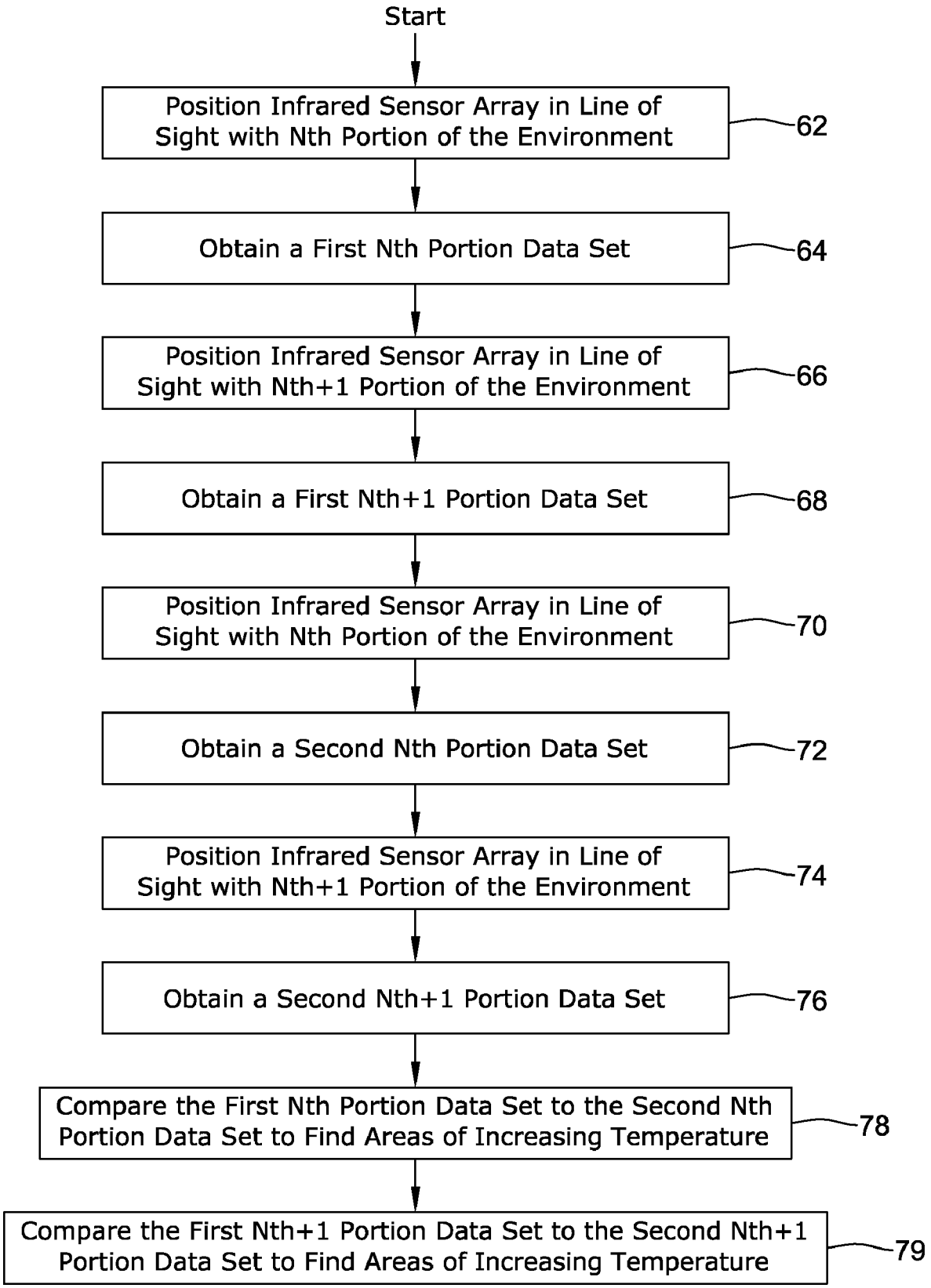
FIG. 9 is a flow diagram showing an illustrative method that may be carried out using the illustrative fire detection system of FIG. 1.

FIG. 9 is a flow diagram showing an illustrative method that may be carried out using fire detection system 10 (FIG. 1). As noted above, and in some cases, the target environment may be too large to be viewed all at once with a single infrared detector array 12 while achieving a desired resolution. Thus, in some cases, it may be useful to divide the target environment into a plurality of portions (e.g. plurality of portions 41*a*-41*o* of FIG. 6) that can be checked sequentially. At block 62, the field of view of the infrared detector array 12 (FIG. 1) may be positioned to view an $n^{th}$ portion, where n is an integer that is less than a total number of portions. In some cases, controller 18 (FIG. 1) may instruct positioning apparatus 14 (FIG. 1) to move infrared detector array 12, optics or mirrors, as appropriate.

Control passes to block 64, where controller 18 (FIG. 1) obtains a first $n^{th}$ portion data set from infrared detector array 12 (FIG. 1). At block 66, the field of view of infrared detector array 12 may be positioned to view an $n^{th}+1$ portion of the target environment, and a first $n^{th}+1$ portion data set may be obtained at block 68. At block 70, the field of view of the infrared detector array 12 may be repositioned to view the $n^{th}$ portion of the target environment, and a second $n^{th}$ portion data set is obtained at block 72. At block 74, the field of view of the infrared detector array 12 may be repositioned to view the $n^{th}+1$ portion of the target environment, and a second $n^{th}+1$ portion data set may be obtained at block 76. Control passes to block 78, where controller 18 compares the first $n^{th}$ portion data set to the second $n^{th}$ portion data set to find areas of increased or increasing temperature. In some cases, control then passes to block 79, where controller 18 compares the first $n^{th}+1$ portion data set to the second $n^{th}+1$ portion data set to find areas of increasing temperature.

Figure 10:
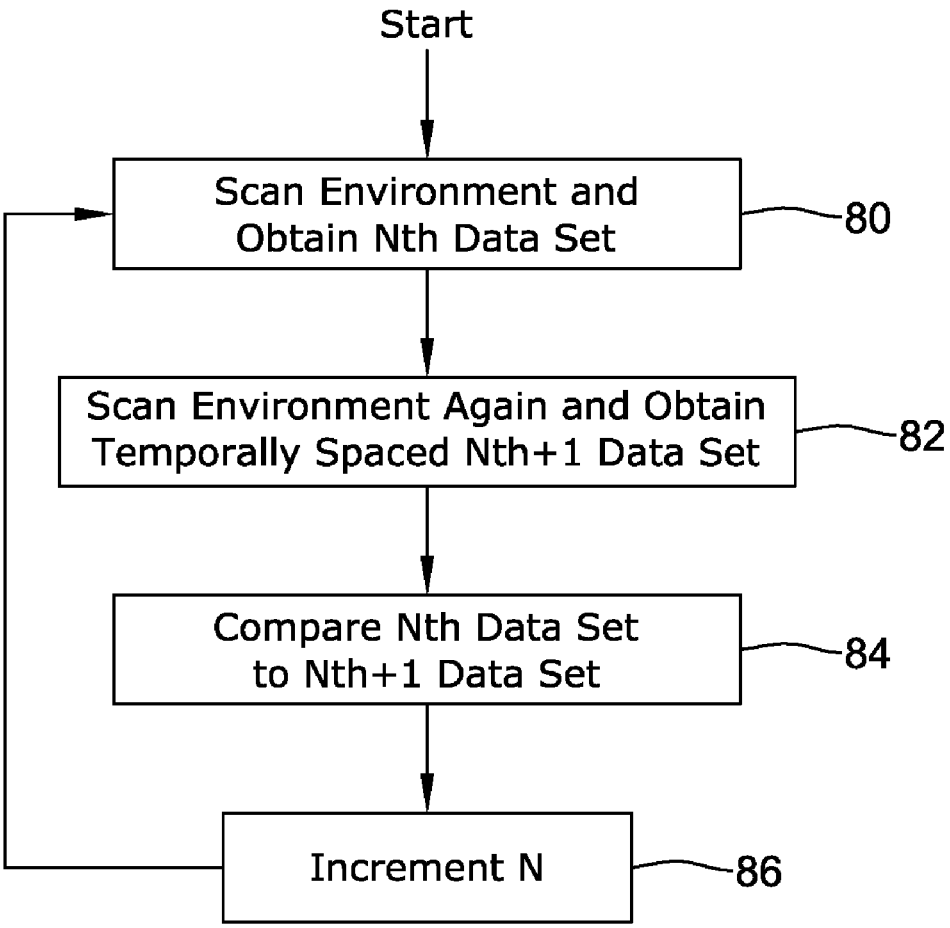
FIG. 10 is a flow diagram showing an illustrative method that may be carried out using the illustrative fire detection system of FIG. 1.

FIG. 10 is a flow diagram showing an illustrative method that may be carried out using fire detection system 10 (FIG. 1). At block 80, a target environment is scanned and an $n^{th}$ data set is obtained. In some cases, the $n^{th}$ data set may represent the data obtained at a particular time or during a particular time period while viewing a particular portion of the target environment. In some instances, the $n^{th}$ data set may represent data obtained from two or more distinct portions of the target environment. At block 82, the target environment is scanned again and a temporally spaced in time $n^{th}+1$ data set is obtained. If the $n^{th}$ data set represents data obtained at a particular time or during a particular time period from a particular portion of the target environment, then the $n^{th}+1$ data set may represent data obtained at a subsequent time or during a subsequent time period from the same particular portion of the target environment. If the $n^{th}$ data set represents data obtained from two or more distinct portions of the target environment, then the $n^{th}+1$ data set may represent data obtained at a subsequent time or during a subsequent time period from the same two or more distinct portions of the target environment.

Control passes to block 84, where controller 18 (FIG. 1) compares the $n^{th}$ data set to the $n^{th}+1$ data set. In some cases, controller 18 may compare the data to determine locations of increasing temperature and/or locations having a temperature above a particular threshold. At block 86, "n" is incremented or otherwise changed, and control reverts to block 80.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

I claim:

1. A method of monitoring a target environment for indications of a fire, the method comprising steps of:

obtaining via a detector a first plurality of data points corresponding to a plurality of spatially arranged locations of a first portion of the target environment, wherein each of the first plurality of data points are related to a temperature value;

obtaining a second plurality of data points corresponding to the plurality of spatially arranged locations of the first portion of the target environment, wherein each of the second plurality of data points are related to a temperature value, the second plurality of data points being temporally spaced in time from the first plurality of data points;

obtaining a third plurality of data points corresponding to a plurality of spatially arranged locations within a second portion of the target environment, wherein each of the third plurality of data points are related to a temperature value, the third plurality of data points obtained after the first plurality of data points but before the second plurality of data points;

identifying a change in temperature from the first plurality of data points and the second plurality of data points.

2. The method of claim 1, wherein identifying step identifies an increase in temperature between at least some of the first plurality of data points and the second plurality of data points.

3. The method of claim 1, wherein identifying step compares an $n^{th}$ data point of the first plurality of data points to a corresponding $n^{th}$ data point of the second plurality of data points.

4. The method of claim 3, wherein the $n^{th}$ data point of the first plurality of data points and the corresponding nth data point of the second plurality of data points provide information pertaining to a common location within the first portion of the target environment.

5. The method of claim 3, wherein the $n^{th}$ data point of the first plurality of data points and the corresponding $n^{th}$ data point of the second plurality of data points are compared for each "n" ranging from 1 to a number that specifies how many locations are within the first portion of the target environment.

6. The method of claim 1, wherein the step of obtaining a first plurality of data points comprises directing a field of view of an infrared detector array at the spatially arranged locations within the first portion of the target environment, wherein each of the spatially arranged locations corresponds to a corresponding detector of the infrared detector array.

7. The method of claim 1, wherein the spatially arranged locations within the first portion are arranged in rows and columns.

8. A method of monitoring a target environment for indications of a fire, the method comprising steps of:

obtaining via a detector a first plurality of data points corresponding to a plurality of spatially arranged locations of a first portion of the target environment, wherein each of the first plurality of data points are related to a temperature value;

obtaining a second plurality of data points corresponding to the plurality of spatially arranged locations of the first portion of the target environment, wherein each of the second plurality of data points are related to a temperature value, the second plurality of data points being temporally spaced in time from the first plurality of data points;

identifying a change in temperature from the first plurality of data points and the second plurality of data points;

obtaining a third plurality of data points corresponding to a plurality of spatially arranged locations within a second portion of the target environment, wherein each of the third plurality of data points are related to a temperature value, the third plurality of data points obtained after the first plurality of data points but before the second plurality of data points;

obtaining a fourth plurality of data points corresponding to spatially arranged locations within the second portion of the target environment, wherein each of the forth plurality of data points are related to a temperature value, the fourth plurality of data points obtained after the second plurality of data points; and identifying a change in temperature from the third plurality of data points and the fourth plurality of data points.

9. The method of claim 8, wherein the second portion of the target environment is at least partially different from the first portion of the target environment.

10. A method of monitoring a target environment for indications of a fire, the method comprising the steps of:

positioning an infrared detector array so that a field of view of the infrared detector array corresponds to at least a portion of the target environment, the infrared detector array having an array of detectors;

obtaining a first data set representing detector values obtained from each detector within the infrared detector array;

storing the first data set;

obtaining a second data set temporally spaced in time from the first data set, the second data set representing detector values obtained from each detector within the infrared detector array;

comparing the first data set to the second data set to find areas of increasing temperature; and subsequent to obtaining the first data set and prior to obtaining the second data set, repositioning the infrared detector array so that the field of view of the infrared detector array corresponds to another portion of the target environment.

11. The method of claim 10, wherein the comparing step comprises comparing a detector value within the first data set corresponding to a particular location within the target environment to a detector value within the second data set corresponding to the same particular location within the target environment.

12. The method of claim 10, further comprising obtaining and comparing at least two additional data sets corresponding to the portion of the target environment.

13. The method of claim 10, further comprising obtaining and comparing at least two data sets corresponding to the another portion of the target environment.

14. A method of monitoring a target environment for indications of a fire, the method comprising the steps of:

positioning an infrared detector array so that a field of view of the infrared detector array includes an $n^{th}$ portion of the target environment, the infrared detector array having an array of detectors;

obtaining a first $n^{th}$ portion data set representing detector values obtained from at least a majority of the detectors within the infrared detector array;

positioning the infrared sensor array so that a field of view of the infrared detector array includes an $n^{th}+1$ portion of the target environment;

obtaining a first $n^{th}+1$ portion data set representing detector values obtained from at least a majority of the detectors within the infrared detector array;

positioning the infrared detector array so that a field of view of the infrared detector array includes the $n^{th}$ portion of the target environment;

obtaining a second $n^{th}$ portion data set representing detector values obtained from at least a majority of the detectors within the infrared detector array;

positioning the infrared detector array so that a field of view of the infrared detector array includes the $n^{th}+1$ portion of the target environment;

obtaining a second $n^{th}$ portion data set representing detector values obtained from at least a majority of the detectors within the infrared detector array; and comparing the first $n^{th}$ portion data set to the second $n^{th}$ portion data set to find areas of increased or increasing temperature.

15. The method of claim 14, wherein, if the comparing step indicates an area of increased or increasing temperature, the infrared detector array is positioned so that the field of view of the infrared detector array includes the $n^{th}$ portion of the target environment so that additional data sets may be obtained.

16. The method of claim 14, further comprising comparing the first $n^{th}$ +1 portion data set to the second $n^{th}$+1 portion data set to find areas of increased or increasing temperature.

17. The method of claim 16, wherein, if the comparing step indicates an area of increased or increasing temperature, the infrared detector array is positioned so that the field of view of the infrared detector array includes the $n^{th}$+1 portion of the target environment so that additional data sets may be obtained.

18. The method of claim 14, where "n" is an integer that ranges from 1 to one less than a total number of portions within the target environment.

* * * * *